US005246382A

United States Patent [19]

Kerek et al.

[11] Patent Number: 5,246,382

[45] Date of Patent: Sep. 21, 1993

[54] CRIMPLESS, SOLDERLESS, CONTACTLESS, FLEXIBLE CABLE CONNECTOR

[75] Inventors: Leslie Kerek; Stephen K. Kan, both of Los Angeles, Calif.; Larry Eaton, High Ridge, Mo.

[73] Assignee: G & H Technology, Inc., Camarillo, Calif.

[21] Appl. No.: 844,206

[22] Filed: Mar. 2, 1992

[51] Int. Cl.[5] ..... H01R 13/00

[52] U.S. Cl. ..... 439/495

[58] Field of Search ..... 439/492–499

[56] References Cited

U.S. PATENT DOCUMENTS

| | | | |
|---|---|---|---|
| 2,952,002 | 9/1960 | Angele et al. | 439/495 |
| 3,141,720 | 7/1964 | Johnson | 439/496 |
| 3,278,887 | 10/1966 | Travis | 439/496 |
| 4,971,575 | 11/1990 | Martellotti | 439/496 |
| 5,123,852 | 6/1992 | Gillett | 439/496 |

FOREIGN PATENT DOCUMENTS

| | | | |
|---|---|---|---|
| 1234903 | 5/1986 | U.S.S.R. | 439/496 |

*Primary Examiner*—Joseph H. McGlynn
*Attorney, Agent, or Firm*—George J. Netter

[57] ABSTRACT

An end portion of a multiconductor cable (16, 18) is formed about an edge portion (28) of a sheetlike core (27) with portions of bared cable conductors (26) facing outwardly. The other cable (20, 22) is similarly arranged about an edge of a core (34). On the connector parts- (12, 14) being mated the bared cable conductors of cable (16, 18) are brought into contact with the bared conductors of cable (20, 22).

6 Claims, 3 Drawing Sheets

CRIMPLESS, SOLDERLESS, CONTACTLESS, FLEXIBLE CABLE CONNECTOR

BACKGROUND OF THE INVENTION

1. Field of the Invention

The present invention relates generally to multi-conductor flexible electrical cables, and, more particularly, to connector apparatus for interconnecting two such cables without conventional contacts and without requiring recourse to soldering or crimping.

2. Description of Related Art

A multi-conductor flexible electrical cable generally consists of a ribbonlike flexible substrate constructed of an electrically insulative material having on an outer surface a plurality of spaced apart conductive strips or leads. All known techniques for interconnecting two such cables to one another in a one-for-one conductor connection involve the use of relatively complex and expensive apparatus. The repeated connect/disconnect mode is very cumbersome. Moreover, some of these connectors are not fully reliable in operation, either in breaking connection when exposed to relatively modest levels of vibration or developing intermittent contact breakage during use.

U.S. Pat. No. 4,802,866, CONNECTOR, by A. Balzano discloses a connector in which bared conductors of a multi-conductor are formed about the edge of an insulative plate to form one half of the connector. The other connector half consists of a loop of bare metal conductors within which the first connector half nests during mating. Spring members aid connection by applying lateral pressure.

U.S Pat. No. 3,897,130 by Donnelly et al. overlaps bared conductor tracks of two cables and clamps them together by a plug 22 to effect interconnection.

SUMMARY OF THE DISCLOSURE

In accordance with the practice of the described invention, an end portion of one of the cables to be connected is formed about an edge of a support member with exposed and bared cable conductors facing away from the support member. The support member edge may be tapered to provide a reduced edge thickness for carrying the cable conductors. The other cable has an end portion formed about the edge of a further support member, the edge thickness of which is greater than that of the first support member. The edges of the two resiliently loaded members are so configured or modified with an alignment feature as to enable being brought into resilient continuous contact with one another.

Separate housing means are provided for each of the support members with cables, which housing means can be releasably locked together so that the cable end portions formed about the support member edges are brought into approximate, aligned with a resilient Hertzian ohmic contact with each other.

DESCRIPTION OF PREFERRED EMBODIMENTS

Figure 1:
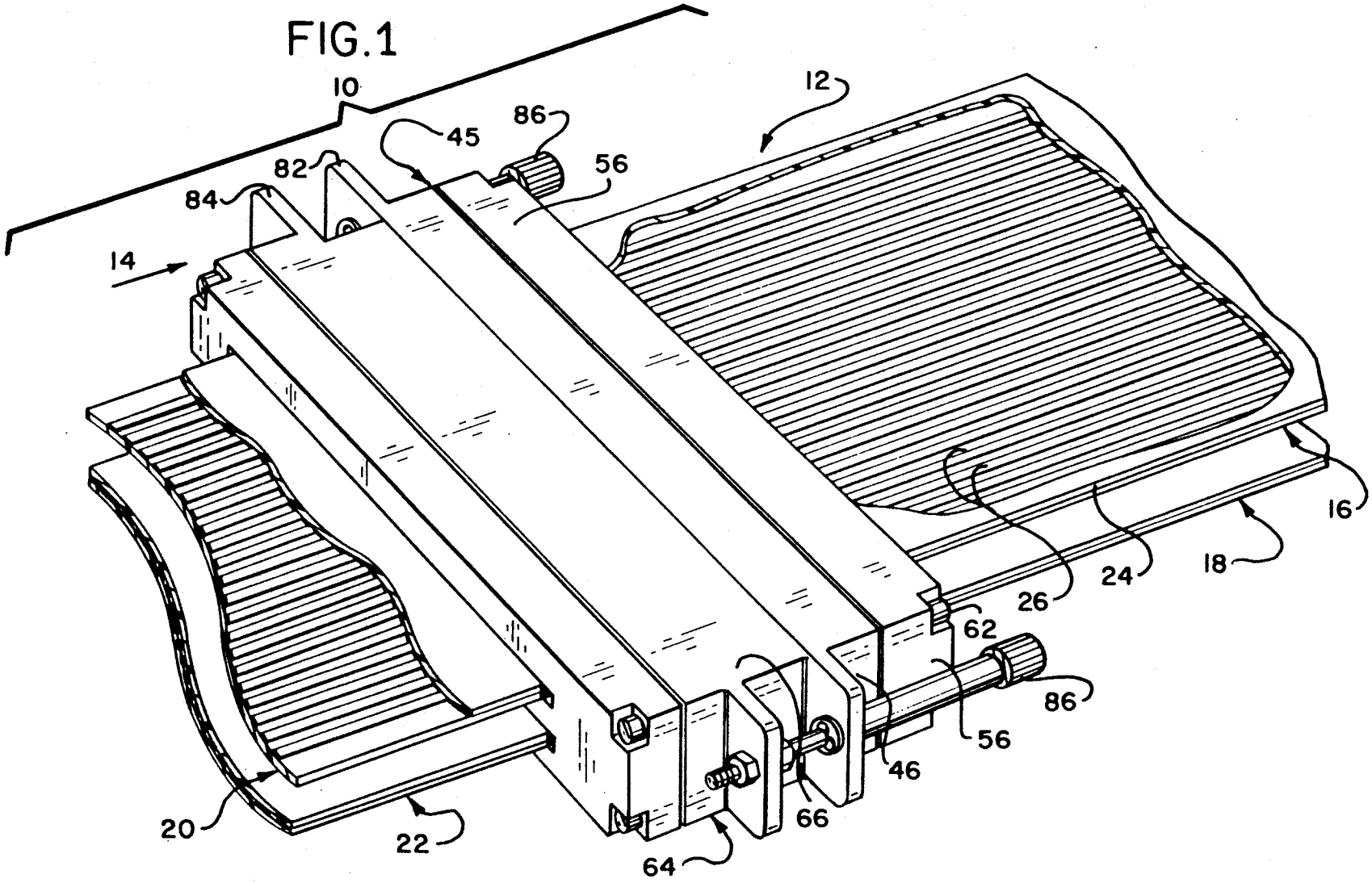
FIG. 1 is an isometric view of the connector of this invention shown in connection mode.
Figure 2:
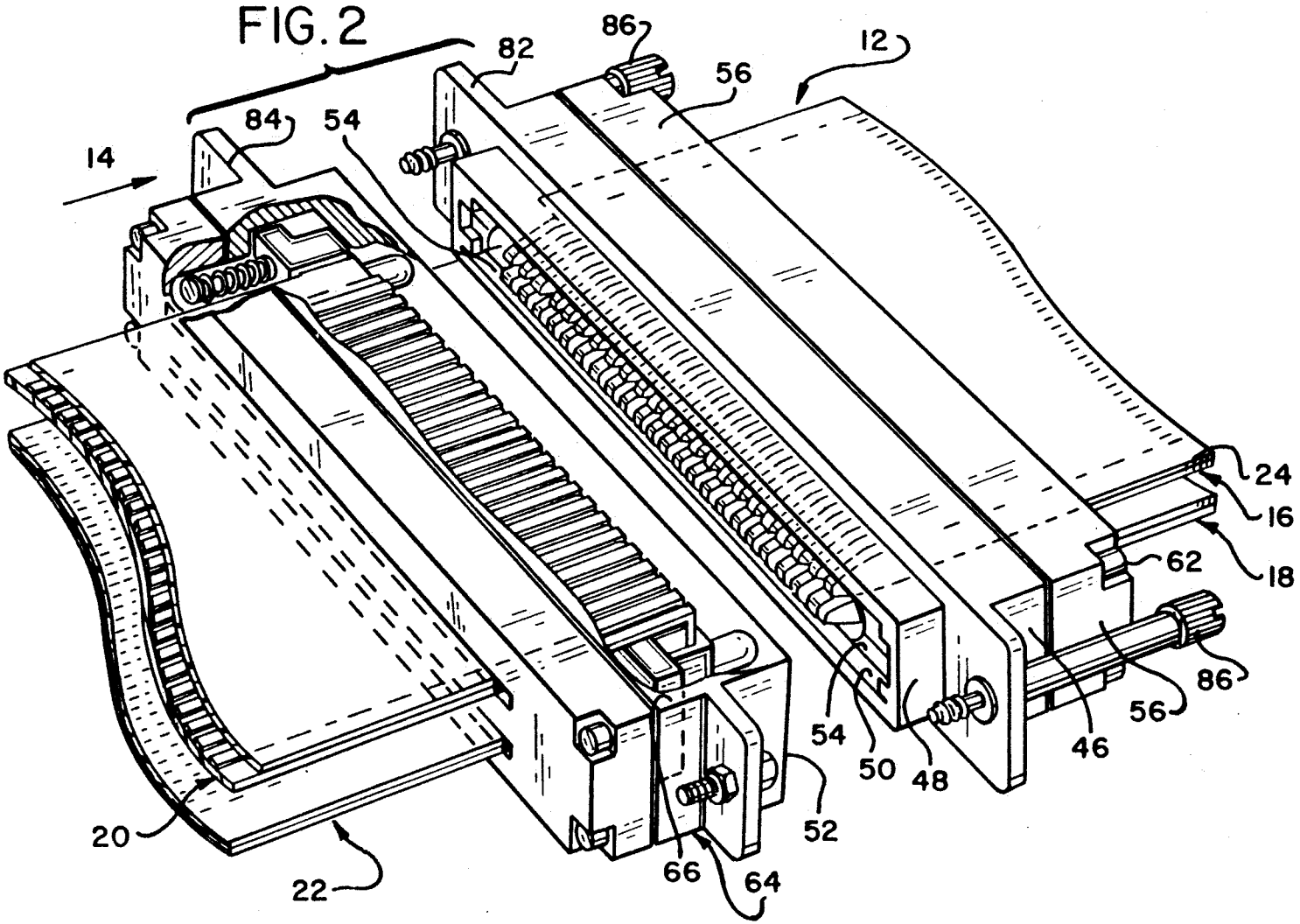
FIG. 2 is a further isometric view of the connector shown disconnected.

As can be best seen by simultaneous reference to FIGS. 1 and 2, the connector of this invention enumerated generally as 10 has first and second connector parts 12 and 14 for releasably interconnecting first multi-conductor cables 16 and 18 respectively to second multi-conductor cables 20 and 22. As enumerated on cable 16 alone, the cables each consist of a flexible electrically insulative strip or ribbon 24 having on an outer surface a plurality of spaced apart conductors 26 extending longitudinally of the strip. Alternatively, the conductors can be embedded within the strip. In either cable version, it is an important initial step to practicing the invention that an end portion of the cable have insulative material removed that may cover the conductors, at least on one side, so that a major surface of the cable end portion has the conductors 26 bared and available for a Hertzian ohmic contact.

Figure 4:
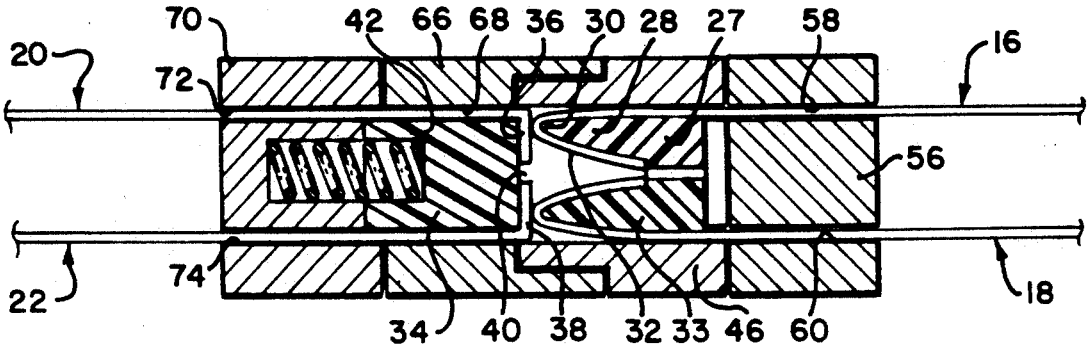
FIG. 4 is a side elevational, sectional view taken along the line 4—4 in FIG. 3.

The first connector part 12 includes first and second sheetlike insulative cores 27 having a tapered edge portion 28 with a reduced thickness outer edge surface 30 (FIG. 4). The cores can be made of any one of many different materials possessing sufficient rigidity.

As can be seen best in FIG. 4, the end portion 32 of the cable 16 is prepared as already described with the conductors 26 bared on one side of the ribbon 24. Then, the prepared cable end is wrapped around and attached to the tapered core edge portion 28 with the bared conductors 26 facing outwardly and away from the edge surface 30. The attachment may be accomplished in any of a number of different ways (e.g., adhesive) provided that attachment will not interfere with electrical connection with the cable 20 in a manner to be described. Similarly, cable 18 is mounted onto the second tapered edge core 33 in the same manner as cable 16.

On the connector part 14, a further generally rectangular core 34 made of a rigid material has the prepared end portions 36 and 38 of cables 20 and 22 folded onto the same end surface 40 with the remainder of the cables extending in the same direction away from surface 40 along the core sides 42 and 44, respectively. These core sides are parallel to one another so that individual cable conductors of cables 20 and 22 extending onto the end surface 40 can be aligned to each other and arranged generally normal to the sides.

A housing 45 for the first connector part 12 includes a hollow shell 46 with a forwardly directed rectangular guide flange 48 (FIGS. 1 and 2). The cavity 50 is so dimensioned as to receive the tapered cores 27 and 33 with cables and allowing the core tapered edges to extend into the open front 52 defined by the guide flange 48. End parts 54 of the cores lying outwardly of the cables contact the inner walls of cavity 50 holding cables spaced from the walls of shell 46. A rear wall 56 (FIG. 4), includes first and second elongated slots 58 and 60 through which cables 16 and 18 can, respectively, pass. In assembly, the rear wall is secured to the open rear of shell 46 by one or more threaded members 62 (FIG. 3).

With respect to both FIGS. 1 and 4, a housing 64 for connector part 14 includes a hollow rectangular shell 66 having an internal cavity 68 of such dimensions as to enable receipt of the core 34 and cables 16 and 18 therein. The front face of the shell 66 is configured to receive the flange 48 therewithin. A rear plate 70 having a pair of slits 72 and 74 for accommodating the cables 20 and 22 is secured over the rear of the shell 66.

Figure 3:
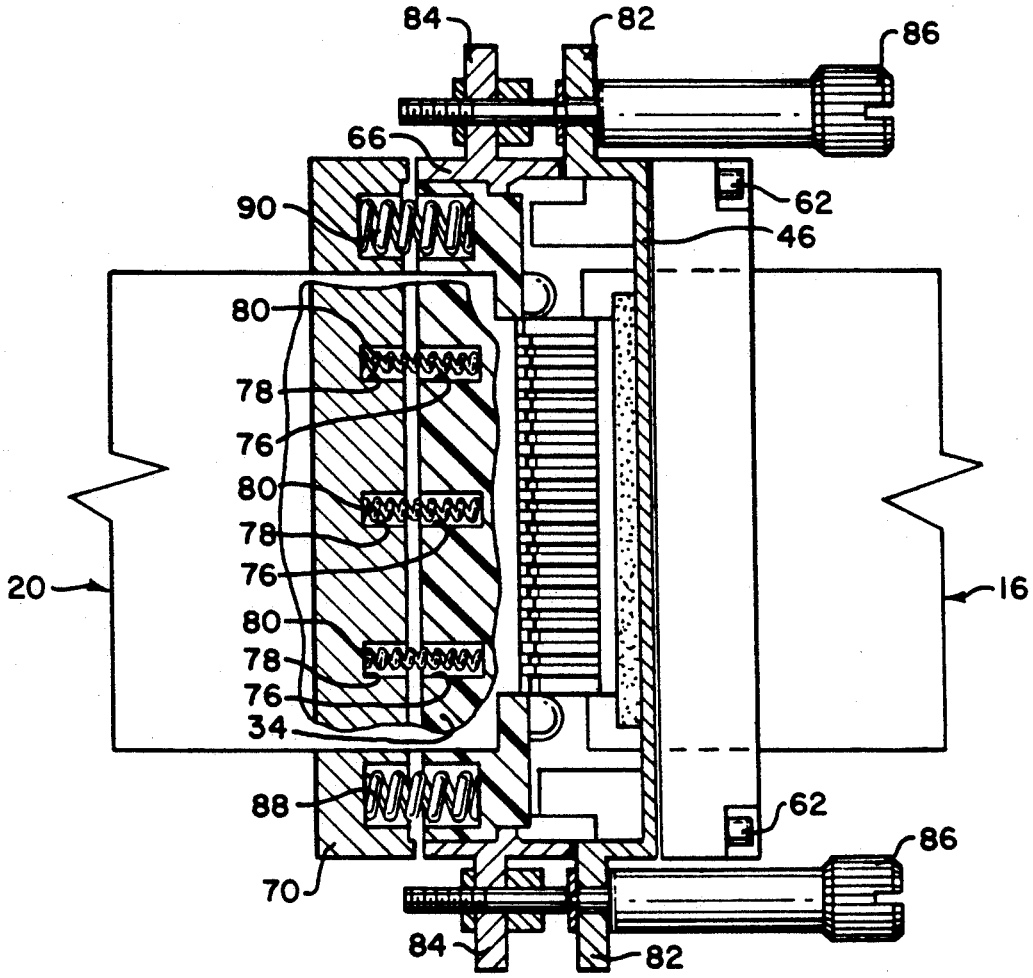
FIG. 3 is a plan, partially sectional view of the connector.

As can be seen best in FIG. 3, bottomed openings 76 in the core 34 align with bottomed openings 78 in the rear wall within which coil springs 80 are received to resiliently urge the core outwardly through the shell front face opening.

Laterally extending flanges 82 on housing shell 46 are so located with respect to flanges 84 on shell 66 as to permit securement of the connector parts by threaded members 86, for example. Coil springs 88 and 90 have their opposite ends received within recesses in the flanges 82 and 84 providing resilient engagement between the connector parts.

On the two connector parts 12 and 1 being assembled together (FIGS. 1 and 4) and the threaded members 86 tightened (FIG. 3), the bare end portions 36 of the conductor on cable 20 are resiliently pressed against the bare ends of the conductors on cable 16 at the tapered edge 30 of insert 27 as are the bare end portions 38 of cable 22 against the bare end portions of conductors for cable 18. Advantages of using a relatively narrow contact areas of the conductors on cables 16 and 18 as compared to those on cables 20 and 22 are that improved individual conductor-to-conductor Hertzian ohmic contact is obtained and there is reduced possibility of shorting out with adjacent cable conductors in the event of minor skewing of the cables within the connector parts.

It will be readily seen that the objects of the invention among those made apparent from the preceding description, are efficiently attained, and, since certain changes may be made without departing from the scope of the invention, it is intended that all matter contained in the above description, or shown in the accompanying drawing, be interpreted as illustrative and not in a limiting sense.

What is claimed is:

1. A releasable electrical connector for first and second multi-conductor cables, each cable having an end portion with the conductors bare on at least one side of the cable, comprising:

a first connector part including first housing means, a first core having an edge located within the housing means with the bare conductor end portion of the first cable being wrapped around the first core edge;

a second connector part including, second housing means, a second core with an edge received within the second housing with the bare conductor end portion of the second cable being wrapped around the second core edge; and means for releasably moving the first and second connector parts together and bringing the bare conductors on the first and second core edges into individual conductor-to-conductor direct abutting contact during mating of the connector parts with the contact pressure applied without sliding between the contacting bare conductors.

2. A releasable electrical connector as in claim 1, in which spring means are provided in one of the housing means for providing resiliency to the contact of the cable bare conductors to one another.

3. A releasable electrical connector as in claim 1, in which the means for releasably joining includes complementary means on the first and second housing means which fit together during mating of the connector parts for aligning the bare conductors of the two cables with one another.

4. A releasable electrical connector as in claim 1, in which a third core is provided in the first housing for receiving an end portion of a third multi-conductor cable having the conductors bared; said second core having a relatively thick edge surface which adjoins two opposite side surfaces for receiving the bare conductors of the second cable extending from one side surface partway onto the edge surface, said remaining edge surface for receiving the end portion with bared conductors of a fourth cable; on mating of the connector parts the conductors of the first cable interconnect with the conductors of the second cable, and the conductors of the third cable with the conductors of the fourth cable.

5. A releasable electrical connector as in claim 1, in which the first core edge has a tapered portion with a reduced thickness outer edge for receiving the bare conductor end portion of the first cable over the first core reduced thickness edge; the second core edge having a surface thicker than the reduced thickness edge of the first core for receiving the conductors of the second cable wrapped thereon.

6. A releasable electrical connector as in claim 5, in which the cable end portions with bare conductors are secured to the respective cores by an adhesive.

* * * * *